US010130840B2

(12) United States Patent
Chen et al.

(10) Patent No.: US 10,130,840 B2
(45) Date of Patent: Nov. 20, 2018

(54) PASSIVE MUSCLE TRAINING DEVICE AND METHOD FOR DRIVING THE SAME

(71) Applicant: B. GREEN TECHNOLOGY CO., LTD., Changhua County OT (TW)

(72) Inventors: Yu Chu Chen, Changhua County (TW); Cheng Hsun Huang, Changhua County (TW)

(73) Assignee: B. Green Technology Co., Ltd., Changhua County (TW)

( * ) Notice: Subject to any disclaimer, the term of this patent is extended or adjusted under 35 U.S.C. 154(b) by 0 days.

(21) Appl. No.: 15/637,131

(22) Filed: Jun. 29, 2017

(65) Prior Publication Data

US 2018/0117397 A1 May 3, 2018

(30) Foreign Application Priority Data

Nov. 3, 2016 (TW) ..... 105135683 A

(51) Int. Cl.

| | |
|---|---|
| ***A63B 23/16*** | (2006.01) |
| ***A63B 21/02*** | (2006.01) |
| ***A63B 21/16*** | (2006.01) |
| *A63B 21/055* | (2006.01) |

(52) U.S. Cl.

CPC ..... *A63B 23/16* (2013.01); *A63B 21/023* (2013.01); *A63B 21/16* (2013.01); *A63B 21/055* (2013.01)

(58) Field of Classification Search

CPC ..... A63B 23/16; A63B 21/16; A63B 21/023; A63B 21/055

USPC ..... 482/49

See application file for complete search history.

(56) References Cited

U.S. PATENT DOCUMENTS

2010/0042023 A1* 2/2010 Park ..... A61H 1/0288 601/40

* cited by examiner

*Primary Examiner* — Andrew S Lo

(74) *Attorney, Agent, or Firm* — Rosenberg, Klein & Lee

(57) ABSTRACT

A passive muscle training device includes a base having at least one first link and at least one second link. At least one first rod is pivotably connected to the at least one first link. At least one second rod is pivotably connected to the at least one second link. The at least one first rod and the at least one second rod each have a handle extending beyond the cover on the base. A power input end is pivotably connected to the first rod and drives an eccentric portion of a shaft to swing the at least first rod and the at least one second rod alternatively. The user holds the two handles and the user's muscles are trained by centripetal contraction and centrifugal contraction due to the movement of the handles.

6 Claims, 11 Drawing Sheets

PASSIVE MUSCLE TRAINING DEVICE AND METHOD FOR DRIVING THE SAME

BACKGROUND OF THE INVENTION

1. Fields of the Invention

The present invention relates to a passive muscle training device and a method for driving the passive muscle training device.

2. Descriptions of Related Art

One of the conventional muscle training devices known to applicant is the handle grip strengtheners which comprise two handles with one spring connected between the two handles. The user holds the two handles by one hand, and pulls the two handles toward each other, and the spring generates a resistant force to train the muscles of hand, fingers, and forearm.

Nevertheless, the hand grip strengtheners can only train the muscles in the direction that the muscles contract, and the muscles are trained by way of centripetal contraction. Users can easily give up using the hand trip strengtheners.

Applicant found out that a passive muscle training device can provide the muscles to be trained by both ways of centripetal contraction and centrifugal contraction, and users are not like to give up using the passive muscle training devices.

The present invention intends to provide a passive muscle training device and a method for driving the passive muscle training device to eliminate the shortcomings mentioned above.

SUMMARY OF THE INVENTION

The present invention relates to a method for driving passive muscle training devices, and comprising:

a step (a) of preparing a base: preparing a base having a room within an X-axis, a Y-axis and a Z-axis, a board connected to the base and having at least one first link along the X-axis and at least one second link along the X-axis, two seats connected to the board and a shaft rotatably supported by the two seats;

a step (b) of installing rod mechanism: pivotally connecting at least one first rod to the at least one first link, pivotally connecting at least one second rod to the at least one second link, the at least one first rod and the at least one second rod being located corresponding to each other along the Z-axis, the at least one first rod having a first handle, the at least one second rod having a second handle, at least one connection rod connected to the at least one first rod and the at least one second rod along the X-axis, the at least one connection rod located between the at least one first link and the at least one second link so as to drive the at least one first rod and the at least one second rod, and a step (c) of installing a power unit: installing a power unit to the base so as to drive the shaft along the Y-axis, the shaft having at least one eccentric portion which is pivotably connected to at least one driving rod along the X-axis, the at least one driving rod pivotably connected to the at least one first rod, when the power unit drives the shaft whose eccentric portion drives the at least one first rod via the at least one driving rod, the at least one first rod and the at least one second rod swing alternatively in opposite directions along the X-Z plane so as to be adapted to train user's muscles when holding the first and second handles.

The passive muscle training device of the present invention comprises a base having a room within X-axis, Y-axis and Z-axis. A board is connected to the base and has at least one first link along the X-axis and at least one second link along the X-axis. Two seats are connected to the board and a shaft is rotatably supported by the two seats. At least one first rod extends along the Z-axis and is pivotably connected to the at least one first link. The at least one first rod has a first handle which extends through a hole of a cover mounted to the base. At least one second rod extends along the Z-axis and is pivotably connected to the at least one second link. The at least one second rod has a second handle which extends through another hole of the cover mounted to the base. The at least one first rod is located corresponding to the at least one second rod.

At least one connection rod extends along the X-axis and is pivotably connected between the at least one first rod and the at least one second rod. The at least one connection rod is located between the at least one first link and the at least one second link. A power input end is the shaft and the shaft has an eccentric portion. The eccentric portion is pivotably connected to at least one driving rod along the X-axis. The at least one driving rod is pivotably connected to the at least one first rod.

Preferably, the power input end is driven by a power unit which drives the eccentric portion in the Y-axis.

Preferably, the eccentric portion is located at least one end of the shaft. The power unit includes a motor and a belt which is driven by the motor to drive the shaft. The at least one driving rod is located between the eccentric portion and the power input end. The shaft includes a first belt wheel, and the motor includes a second belt wheel. The belt is trained between the first and second belt wheels.

Preferably, the at least one first link and the at least one second link are separated by a distance. The length of the at least one first link is longer than that of the at least one second link. The length of the at least one first rod is longer than that of the at least one second rod.

Preferably, each of the first handle and the second handle extending through the hole of the cover has a grip mounted thereto.

The primary object of the present invention is to provide a passive muscle training device, wherein the user holds the two handles and the user's muscles are trained by centripetal contraction and centrifugal contraction due to the movement of the handles.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Referring to FIGS. 1 to 4, the passive muscle training device "A" of the present invention comprises a base 1; at least one first rod 2, at least one second rod 3, at least one connection rod 4 and at least one power input end "a".

Figure 1:
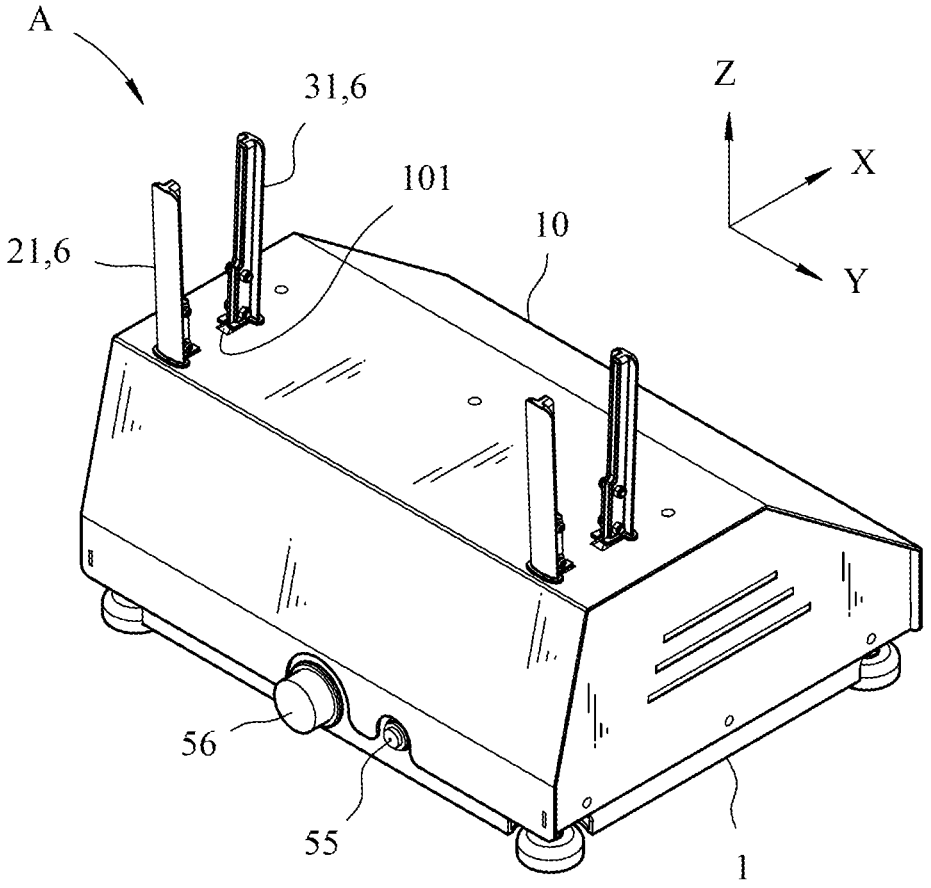
FIG. 1 is a perspective view to show the passive muscle training device of the present invention.
Figure 2:
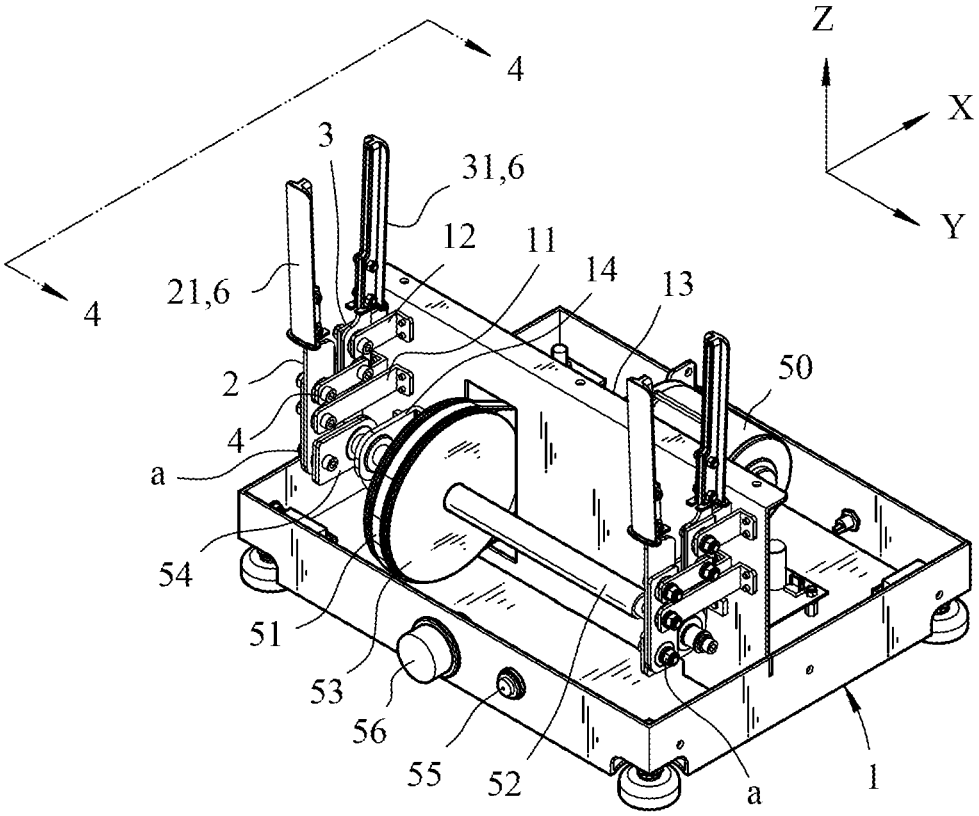
FIG. 2 is a perspective view to show the passive muscle training device of the present invention, wherein the cover is removed.
Figure 3:
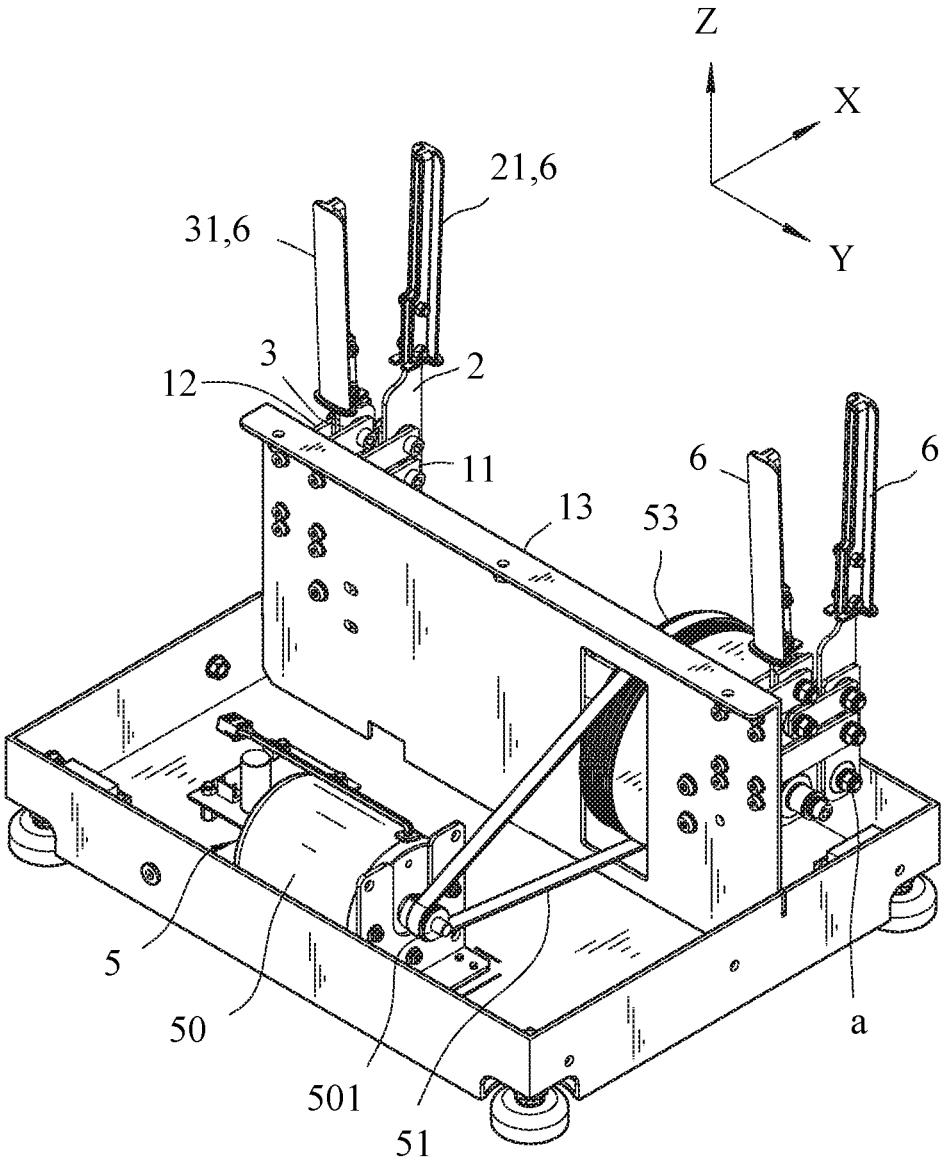
FIG. 3 is another perspective view to show the passive muscle training device of the present invention, wherein the cover is removed.

As shown in FIGS. 1 and 2, the base 1 has a room within an X-axis, a Y-axis and a Z-axis. A board 13 is connected to the base 1 and has at least one first link 11 along the X-axis and at least one second link 12 along the X-axis. In this embodiment, there are two first links 11 and two second links 12. Two seats 14 are connected to the board 13 and a shaft 52 is rotatably supported by the two seats 14. The first link 11 and the second link 12 on each end of the base 1 are separated by a distance. The length of each of the first links 11 is longer than that of each of the second links 12. A cover 10 is mounted to the base 1 and includes fourth holes 101 through which the first and second handles 21, 31 of the first and second rods 2, 3 extend.

Figure 4:
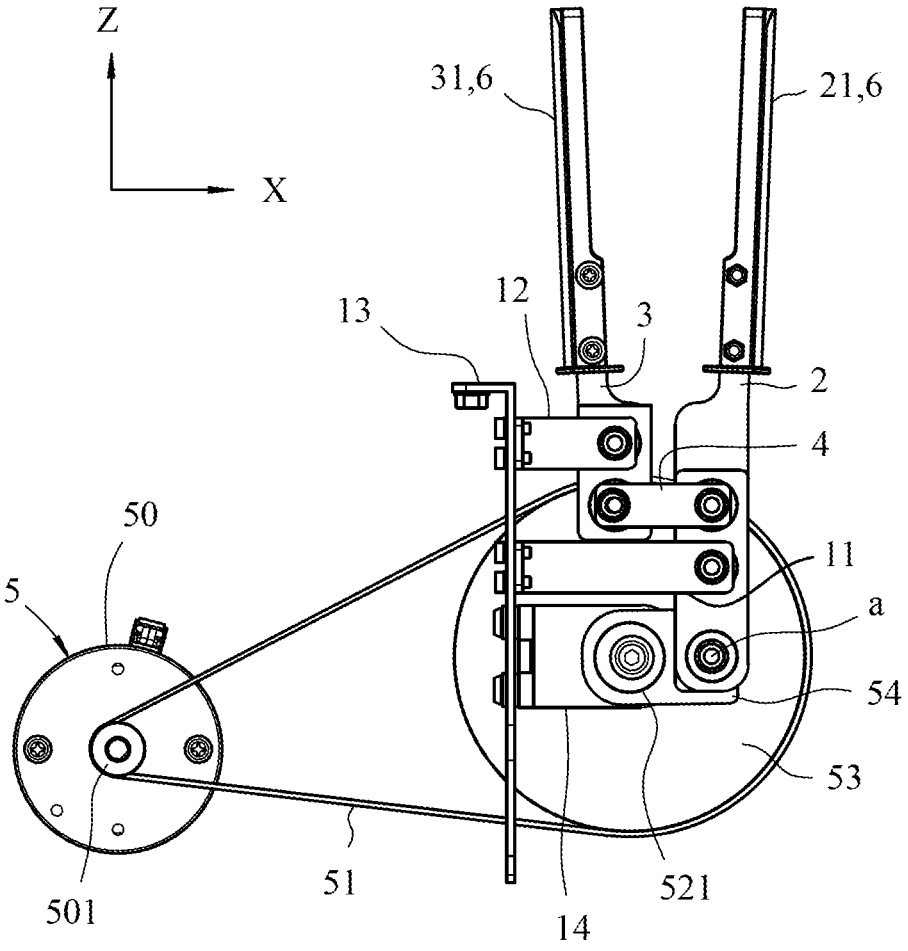
FIG. 4 shows the connection between the power unit, the first and second rods, and the first and second links of the passive muscle training device of the present invention.

As shown in FIGS. 1, 2 and 4, the embodiment includes two first rods 2 which extend along the Z-axis and are pivotably connected to the first links 11. The two first rod 2 each have a first handle 21 which extends through one of the holes 101 of the cover 10 mounted to the base 1.

The embodiment includes two second rods 3 which extend along the Z-axis and are pivotably connected to the second links 12. Each of the two second rods 3 has a second handle 31 which extends through another one of the holes 101 of the cover 10 mounted to the base 1. The first rods 2 are located corresponding to the second rods 3. The length of each of the first rods 2 is longer than that of each of the second rods 3. Each of the first handle 21 and the second handle 31 extending through the hole 101 of the cover 10 has a grip 6 mounted thereto.

As shown in FIGS. 2 and 4, the embodiment includes two connection rods 4 extending along the X-axis and each of the connection rods 4 is pivotably connected between the first rod 2 and the second rod 3 corresponding thereto. Each connection rod 4 is located between the at least one first link 11 and the at least one second link 12.

Figure 5:
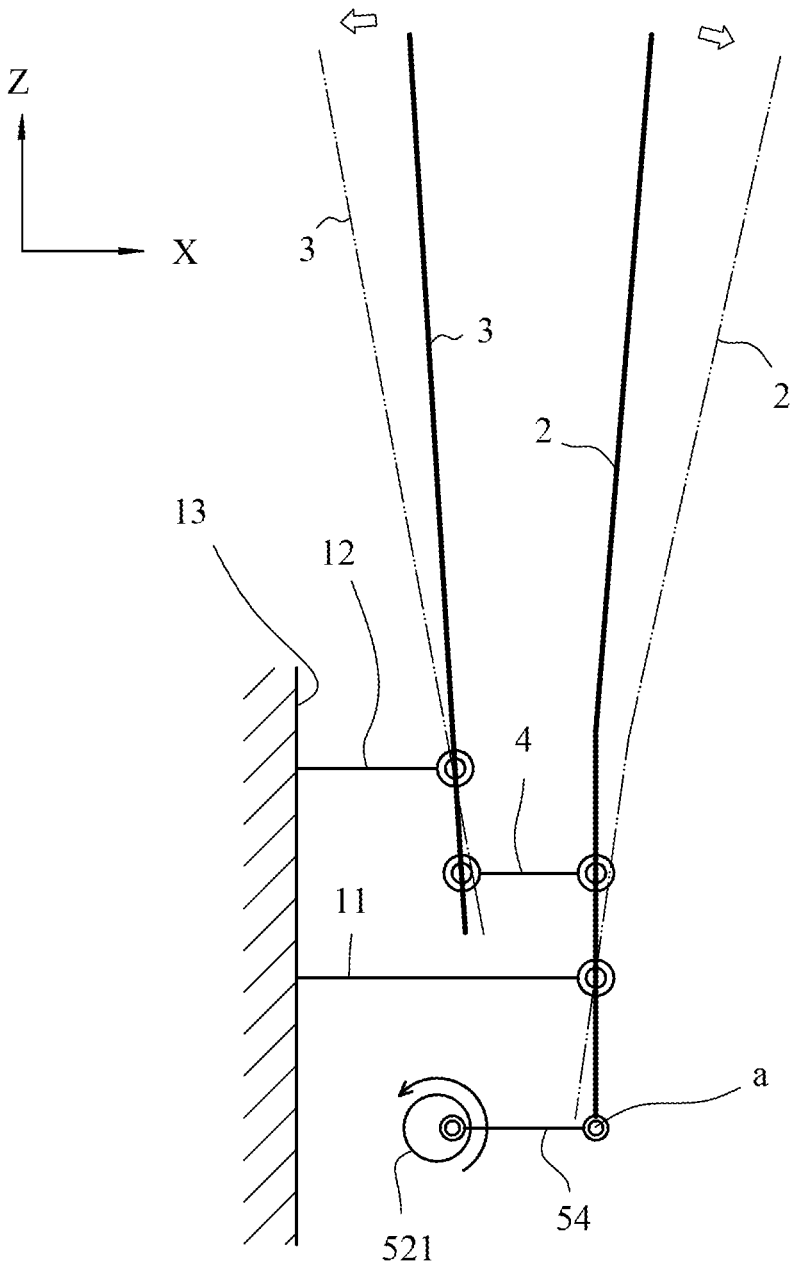
FIGS. 5 and 6 show that the first and second handles alternatively swing back forth of the passive muscle training device of the present invention.

As shown in FIGS. 2, 4 and 5, the embodiment includes two power input ends "a" and each power input end "a" is located at the shaft 52 and specifically, each power input end "a" is located at the eccentric portion 521 on one distal end of the shaft 52 corresponding thereto along the Y-axis. The eccentric portion 521 is pivotably connected to the driving rod 54 corresponding thereto along the X-axis. The driving rod 54 is pivotably connected to the first rod 2 corresponding thereto. The power input end "a" is driven by a power unit 5 which drives the eccentric portion 521 in the Y-axis. The power unit 5 includes a motor 50 and a belt 51 which is driven by the motor 50 to drive the shaft 52. The driving rod 54 is located between the eccentric portion 521 and the power input end "a" corresponding thereto. The shaft 52 includes a first belt wheel 53, and the motor 50 includes a second belt wheel 501. The belt 51 is trained between the first and second belt wheels 53, 501. Each driving rod 54 drives the first rod 2 to swing. The speed of the motor 50 can be controlled by a motor speed adjustment button 56. By operation to the motor speed adjustment button 56, the speed of the motor 50 is controlled, and the speed of swinging of the first and second rods 2, 3 can also be controlled.

Figure 6:
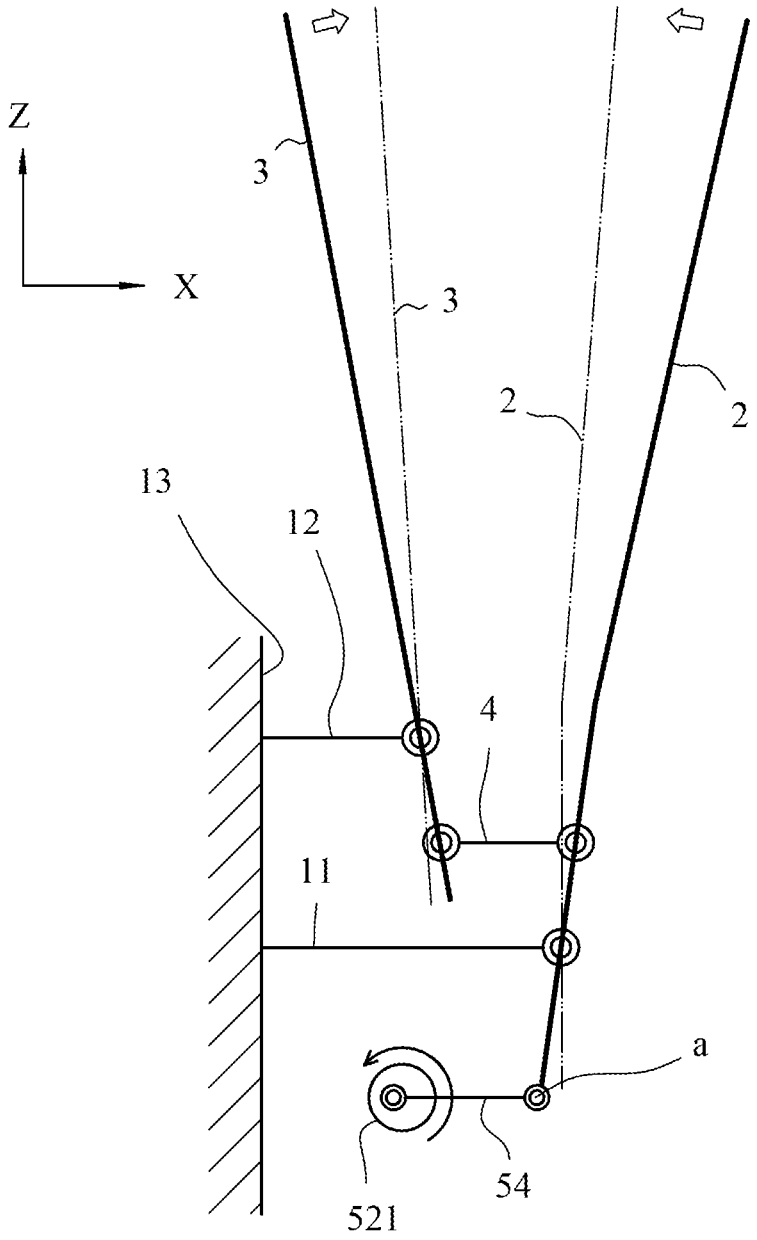

As shown in FIGS. 5 and 6; when the driving rods 54 and the eccentric portions 521 on the shafts 52 are driven, and the first rods 2 swing, each first rod 2 is pivoted about the connection point with the first rod 11. The first rod 2 drives the connection rod 4 corresponding thereto to pivot the second rod 3 to pivot about the connection point with the second link 12 on the X-Z plane, so that the first and second rods 2, 3 alternatively swing back and forth in opposite directions. When the user holes or contacts against the first and second handles 21, 31, the muscles are trained.

Figure 7:
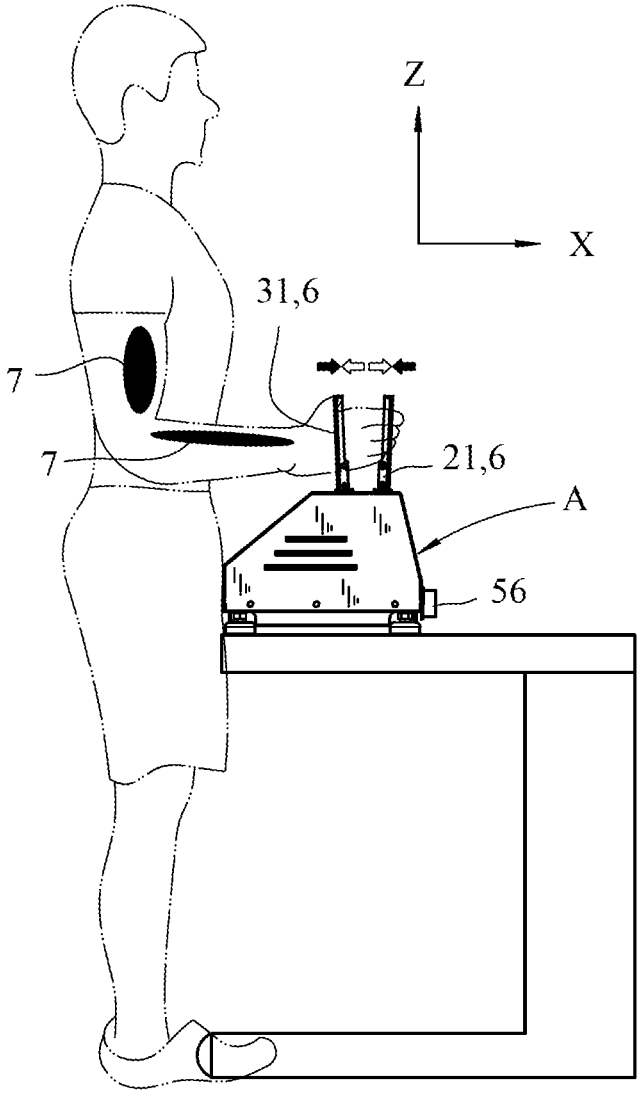
FIG. 7 shows a user using the passive muscle training device of the present invention.
Figure 7A:
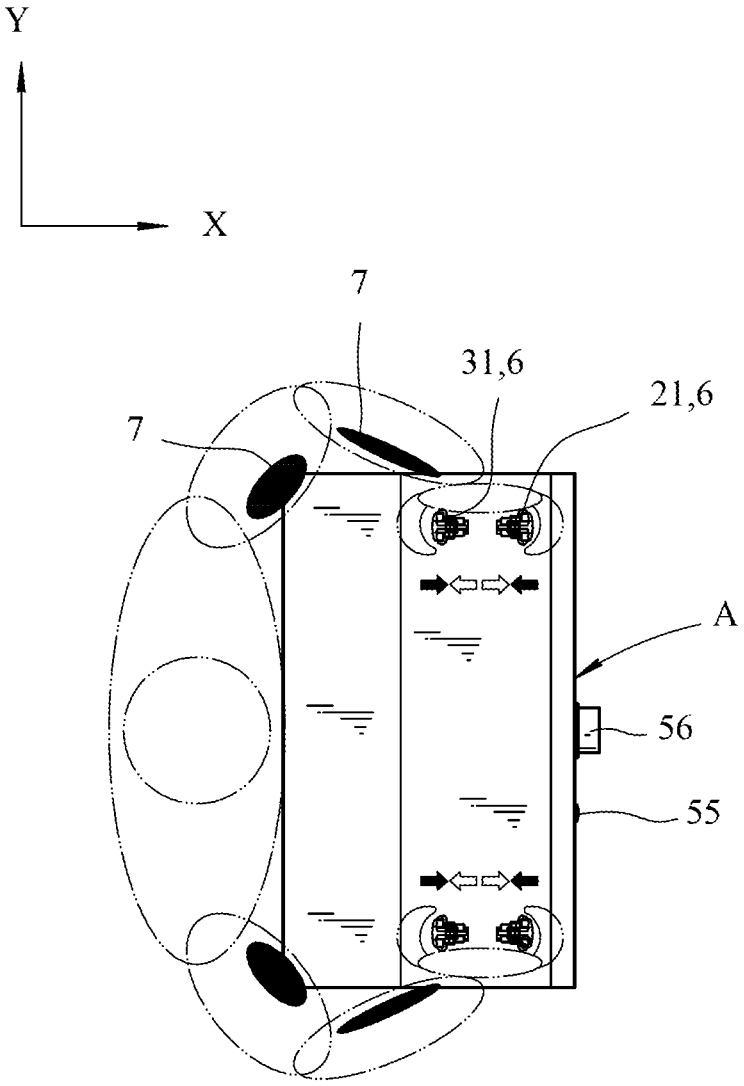
FIG. 7*a* is a top view to show the user using the passive muscle training device of the present invention.

As shown in FIGS. 7 and 7*a*, the passive muscle training device "A" of the present invention is put on a table, the user pushes the power button 55 of the motor 50, and holds the first and second handles 21, 31 which alternatively swing back and forth in opposite directions to exercise the muscles. FIG. 7 shows that the user's two hands holding the grips 6 of the first and second handles 21, 31, because the direction that the hands applying forces to the first and second handles 21, 31 is different from the direction when the first and second handles 21, 31 swing outward. Therefore, the muscles of the handles are exercised by centrifugal contraction. FIG. 7*s* shows that when the first and second handles 21, 31 swing inward. Therefore, the muscles of the handles are exercised by centripetal contraction.

Figure 8:
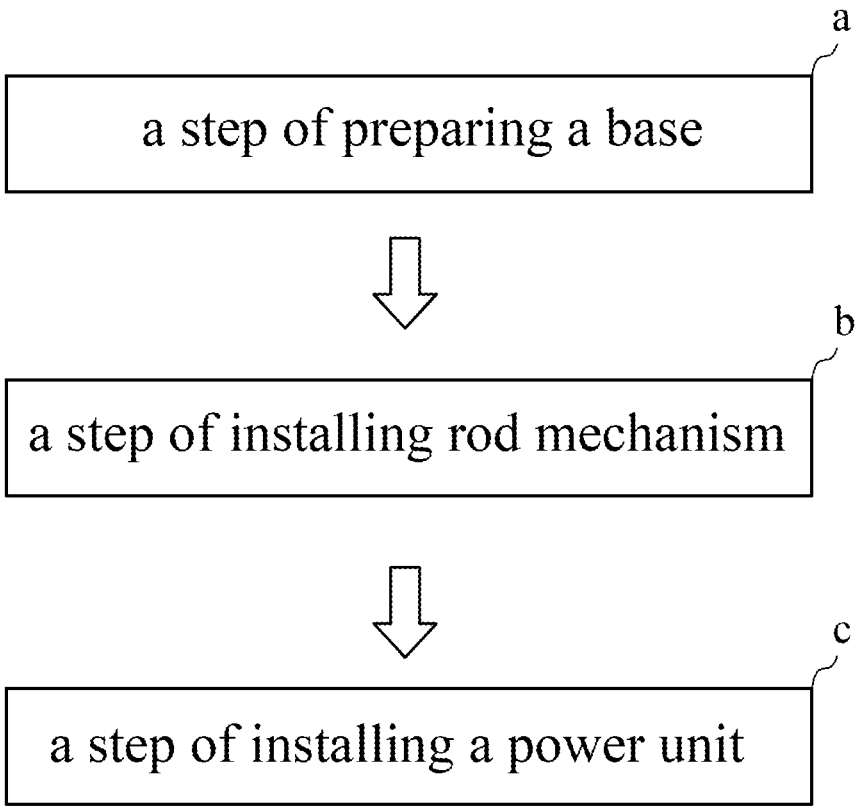
FIG. 8 shows the steps of the method for driving the passive muscle training device of the present invention.

As shown in FIG. 8, the method for driving passive the muscle training device "A" comprises the following steps:

a step (a) of preparing a base: preparing a base 1 having a room within X-axis, Y-axis and Z-axis, a board 13 connected to the base 1 and having at least one first link 11 along the X-axis and at least one second link 12 along the Y-axis, two seats 14 connected to the board 13 and a shaft 52 rotatably supported by the two seats 14;

a step (b) of installing rod mechanism: pivotally connecting at least one first rod 2 to the at least one first link 11, pivotally connecting at least one second rod 3 to the at least one second link 12, the at least one first rod 2 and the at least one second rod 3 being located corresponding to each other along the Z-axis, the at least one first rod 2 having a first handle 21, the at least one second rod 3 having a second handle 31, at least one connection rod 4 connected to the at least one first rod 2 and the at least one second rod 3 along the X-axis, the at least one connection rod 4 located between the at least one first link 11 and the at least one second link 12 so as to drive the at least one first rod 2 and the at least one second rod 3, and a step (c) of installing a power unit: installing a power unit 5 to the base 1 so as to drive the shaft 52 along the Y-axis, the shaft 52 having at least one eccentric portion 521 which is pivotably connected to at least one driving rod 54 along the X-axis, the at least one driving rod 54 pivotably connected to the at least one first rod 2, when the power unit 5 drives the shaft 52 whose eccentric portion 521 drives the at least one first rod 2 via the at least one driving rod 54, the at least one first rod 2 and the at least one second rod 3 swing alternatively in opposite directions along the X-Z plane so as to be adapted to train user's muscles when holding the first and second handles 21, 31.

Figure 9:
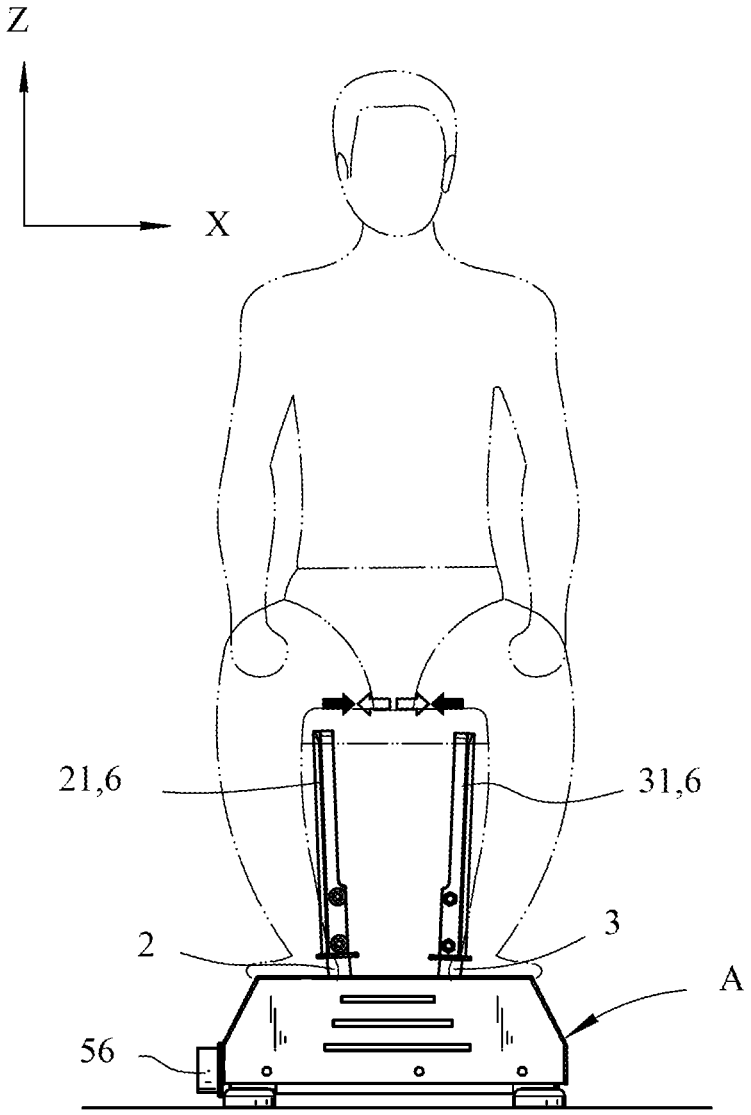
FIG. 9 shows the user trains the muscles of legs by using the passive muscle training device of the present invention.

The length of each of the first and second rods 2, 3 can be made to be long enough so as to train muscles of users' legs. As shown in FIG. 9, the muscle training device "A" is put on the ground, and the user clamp the first and second handles 21, 31 by the inner portions of thighs so as to train the muscles of the legs.

Figure 10:
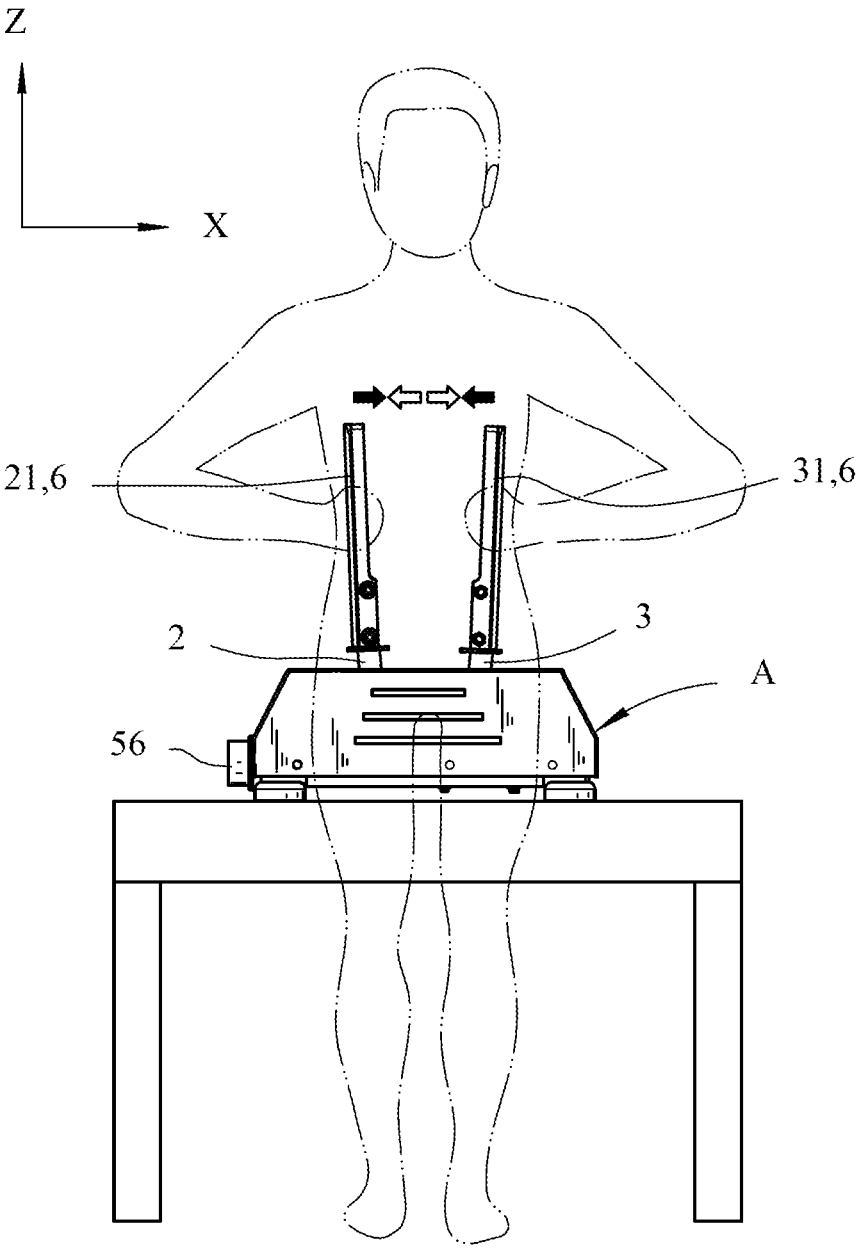
FIG. 10 shows the user trains the muscles of arms by using the passive muscle training device of the present invention.

FIG. 10 shows that, the passive muscle training device A" of the present invention is put on a table, the user's holds the first and second handles 21, 31 by two hands which swing along with the swinging actions of the first and second handles 21, 31 to train the muscles of arms and chest.

While we have shown and described the embodiment in accordance with the present invention, it should be clear to those skilled in the art that further embodiments may be made without departing from the scope of the present invention.

What is claimed is:

1. A method for driving a passive muscle training device, comprising:

a step (a) of preparing a base: preparing a base having a room within an X-axis, a Y-axis and a Z-axis, a board connected to the base and having at least one first link along the X-axis and at least one second link along the X-axis, two seats connected to the board and a shaft rotatably supported by the two seats;

a step (b) of installing rod mechanism: pivotally connecting the at least one first link to a respective first rod, pivotally connecting the at least one second link to a respective second rod, the respective first rod and the respective second rod being located corresponding to each other along the Z-axis, the respective first rod having a first handle, the respective second rod having a second handle, the respective first and second rods being connected to to at least one connection rod along the X-axis and being located between corresponding pivotal connections of the at least one first link and the at least one second link with the respective first and second rods so as to drive the respective first and second rods, and a step (c) of installing a power unit: installing a power unit to the base so as to drive the shaft along the Y-axis, the shaft having a respective eccentric portion pivotally connected to at least one driving rod along the X-axis, the at least one driving rod being pivotally connected to the respective first rod, the respective eccentric portion drives the respective first rod responsive to the power unit driving the shaft via the at least one driving rod, the respective first and second rods swing alternatively in opposite directions along a X-Z plane so as to be adapted to train a user's muscles when holding the first and second handles.

2. A passive muscle training device comprising:

a base having a room within an X-axis, a Y-axis and a Z-axis, a board connected to the base and having at least one first link along the X-axis and at least one second link along the X-axis, two seats connected to the board and a shaft rotatably supported by the two seats;

a plurality of rods extending along the Z-axis, a respective first of the plurality of rods having a first handle and being pivotally connected to the at least one first link, the first handle extending through a hole of a cover mounted to the base, a respective second of the plurality of rods having a second handle and being pivotally connected to the at least one second link, the second handle extending through another hole of the cover mounted to the base, the respective first and second of the plurality of rods being located in correspondence one with respect to the other;

at least one connection rod extending along the X-axis and being pivotally connected between the respective first and second of the plurality of rods and being located between corresponding pivotal connections of the at least one first link and the at least one second link with the respective first and second of the plurality of rods, and a power unit drivingly coupled to the shaft and the shaft having at least one power input end pivotally connected to a respective driving rod along the X-axis, the respective driving rod being pivotally connected to the respective first of the plurality of rods.

3. The passive muscle training device as claimed in claim 2, wherein the at least one power input end is an eccentric portion which is driven by the power unit in the Y-axis.

4. The passive muscle training device as claimed in claim 3, wherein the eccentric portion is located at an end of the shaft, the power unit includes a motor and a belt driven by the motor to drive the shaft, the shaft includes a first belt wheel, the motor includes a second belt wheel and the belt is trained between the first and second belt wheels.

5. The passive muscle training device as claimed in claim 2, wherein the at least one first link and the at least one second link are separated by a distance, a length of the at least one first link is longer than that of the at least one second link, a length of the respective first of the plurality of rods is longer than that of the the respective second of the plurality of rods.

6. The passive muscle training device as claimed in claim 2, wherein each of the first handle and the second handle extending through the holes of the cover have a grip mounted thereto.

* * * * *